US005806770A

United States Patent [19]

Wang

[11] Patent Number: 5,806,770

[45] Date of Patent: Sep. 15, 1998

[54] PISTOL-GRIP NOZZLE

[76] Inventor: Tzu-meng Wang, No. 91, Kuotai Rd., Chunan Chen, Miaoli Hsien, Taiwan

[21] Appl. No.: 723,917

[22] Filed: Sep. 30, 1996

[51] Int. Cl.[6] ..... A62C 31/02

[52] U.S. Cl. ..... 239/391; 239/444; 239/447; 239/526

[58] Field of Search ..... 239/390, 391, 239/394, 397, 436, 443, 447–449, 548, 562, 526, 440, 444

[56] References Cited

U.S. PATENT DOCUMENTS

| | | | |
|---|---|---|---|
| 3,006,560 | 10/1961 | Rosenfranz | 239/526 |
| 4,618,100 | 10/1986 | White et al. | 239/440 |
| 4,776,517 | 10/1988 | Heren | 239/391 |
| 4,785,998 | 11/1988 | Takagi | 239/440 |
| 4,909,443 | 3/1990 | Takagi | 239/526 |
| 4,955,546 | 9/1990 | Liaw | 239/440 |
| 5,323,968 | 6/1994 | Kingston et al. | 239/449 |
| 5,333,792 | 8/1994 | Wang | 239/440 |

*Primary Examiner*—Andres Kashnikow
*Assistant Examiner*—Lisa Ann Douglas
*Attorney, Agent, or Firm*—Rosenberg, Klein & Bilker

[57] ABSTRACT

A pistol-grip nozzle is provided that includes an inverted "L" shaped metal hollow handle formed of a transverse section and a longitudinal section. The transverse section defines a tenon at a bottom portion thereof. A trigger is disposed at an inside juncture of the transverse section and the longitudinal section and adapted for receiving a control device. The control device has a cambered top surface to correspond to the bottom of the transverse section, a groove defined at a center of the cambered surface along a length thereof in order to slidably engage with the tenon of the hollow handle, a series of recesses defined at a bottom thereof to engagingly receive the upward lip of the trigger. Furthermore, a rose is threadedly mounted to a free end of the transverse section of the hollow handle. The rose provides various water patterns under various water pressures supplied by the trigger.

5 Claims, 7 Drawing Sheets

PISTOL-GRIP NOZZLE

BACKGROUND OF THE INVENTION

1. Field of the Invention

The present invention relates to a pistol-grip nozzle and, more particularly to a pistol-grip nozzle having a trigger which is formed to prevent separation from a body thereof and a pattern plate to provide various water patterns under various water pressures.

2. Description of Related Art

Pistol-grip nozzles are commonly used in gardening. Early conventional pistol-grip nozzles generally have a structure as shown in FIG. 9, a pistol-grip nozzle 90 includes an inverted "L" shaped hollow body 91. A rose 94 is threadedly mounted to a free end of a transverse section of the hollow body 91 for spraying various water patterns. A longitudinal section of the hollow body 91 acts as a handle and has two side plates 911 with holes 912 defined therein. A trigger 92 is mounted between the two side plates 911 of the handle 91. A control means 93 is movably mounted in a gap 921 defined between two sides 923 of the trigger 92. The control means 93 has a series of recesses 931 defined at a bottom thereof to control the trigger 92 to provide various water pressures. Also, a spring means 95 is disposed within the handle and provided for operation of the trigger 92. As this kind of pistol-grip nozzle is typically integrally formed of plastics, it may be subject to ageing after being exposed to sunlight and extremes of temperature for a long time. As a result, an improved metal pistol-grip nozzle was developed. However, it is difficult for this kind of pistol-grip nozzle to have integrally formed thereto a pair of side plates with excellent strength on opposed sides of the longitudinal section of the metal pipe and a shaft sleeve is required for mounting the trigger. Therefore, the control means 93 may be separated from the trigger 92 under a large water pressure. A second disadvantage involved in the above mentioned structure is that the rose 94 can only provided a few water patterns so that it can not satisfyingly meet the needs of gardening.

The present invention provides an improved pistol-grip nozzle to mitigate and/or obviate the aforementioned problems.

SUMMARY OF THE INVENTION

One object of the present invention is to provide a pistol-grip nozzle which has a trigger which can be securely retained in a handle of the pistol-grip nozzle.

Another object of the present invention is to provide a pistol-grip nozzle which has a pattern plate providing various water pattern under various water pressures.

In accordance with one aspect of the present invention, the pistol-grip nozzle comprises an inverted "L" shaped hollow metal handle formed of a transverse section and a longitudinal section communicated therewith. The transverse section has a valve disposed therein and defines a tenon at a bottom and along a length thereof. The longitudinal section has a push rod disposed therein. A rose is threadedly mounted to a free end of the transverse section of the hollow tube. A trigger is disposed at an inside a juncture of the transverse section and the longitudinal section. The trigger has a base and a pair of side pieces oppositely disposed on a top portion of the base in order to define a space therebetween. The trigger further has a pair of flanges integrally and oppositely extending from a front edge of each side piece and an upward lip traversing the bottoms of two side flanges. A control means is received within the space defined by the trigger. The control means has a cambered top surface to correspond to the bottom of the transverse section of the hollow handle, a groove defined at a center of the cambered surface along a length thereof to slidably receive the tenon of the hollow handle, a guide post integrally extending from an appropriate position at an inner end, a series of recesses defined at a bottom thereof to engagingly receive the upward lip of the trigger according to requirements, a pair of wing members provided on a top and rear portion of opposed sides thereof, and a pair of stop levers respectively provided beneath the wing members and retained by the pair of flanges of the trigger.

In accordance with another aspect of the present invention, the transverse section further has a shaft sleeve transversely mounted at a rear portion therebeneath approaching the juncture with the longitudinal section for mounting the trigger by a pin passing therethrough.

In accordance with a further aspect of the present invention, the transverse section of the hollow body further comprises a shift sleeve longitudinally formed at an inside of the shaft sleeve for receiving the guide post of the control means of the trigger.

In accordance with still a further aspect of the present invention, the pistol-grip nozzle comprises an inverted "L" shaped hollow metal handle formed of a transverse section and a longitudinal section communicated therewith. The transverse section has a male thread on a free end thereof. A trigger is disposed at an inside a juncture of the transverse section and the longitudinal section. A rose is threadedly mounted to a free end of the transverse section of the hollow tube via a connecting pipe. The rose includes a hollow body shaped as a cylinder with a male thread, a rotator with a female thread threadedly engaged with the hollow body, a distribution pipe arranged at a center of the body so that it defines an outer space and an inner space in the body, said distribution pipe having a first seal loop disposed between an outside wall thereof and an inside wall of the body, an outlet pipe communicated with the connecting pipe and disposed within the distribution pipe, said outlet pipe being divided into a first chamber and a second chamber, said first chamber defining a plurality of openings at a periphery of the pipe wall thereof in order to communicate with a tapered front end which defines a central hole therein, said second chamber defining a plurality of holes on the pipe wall thereof approaching to the first chamber and having a second seal loop disposed between an inside wall of the distribution pipe and an outside wall of the second chamber of an outlet pipe, a pattern plate mounted within a front portion of the body, said pattern plate having a plurality of apertures defined thereon to communicate with the outer space defined by the distribution pipe and a plurality of throats in communication with the apertures, and a cover threadedly mounted to the rotator to fasten the pattern plate by means of a collar extending from the periphery of the pattern plate.

In accordance with still a further aspect of the present invention, a tapered hole and a gap are each defined by an inner space wall of the distribution pipe and the wall of the tapered front end of the first chamber.

Other objects, advantages and novel features of the invention will become more apparent from the following detailed description when taken in conjunction with the accompanying drawings.

DETAILED DESCRIPTION OF PREFERRED EMBODIMENT

Figure 1:
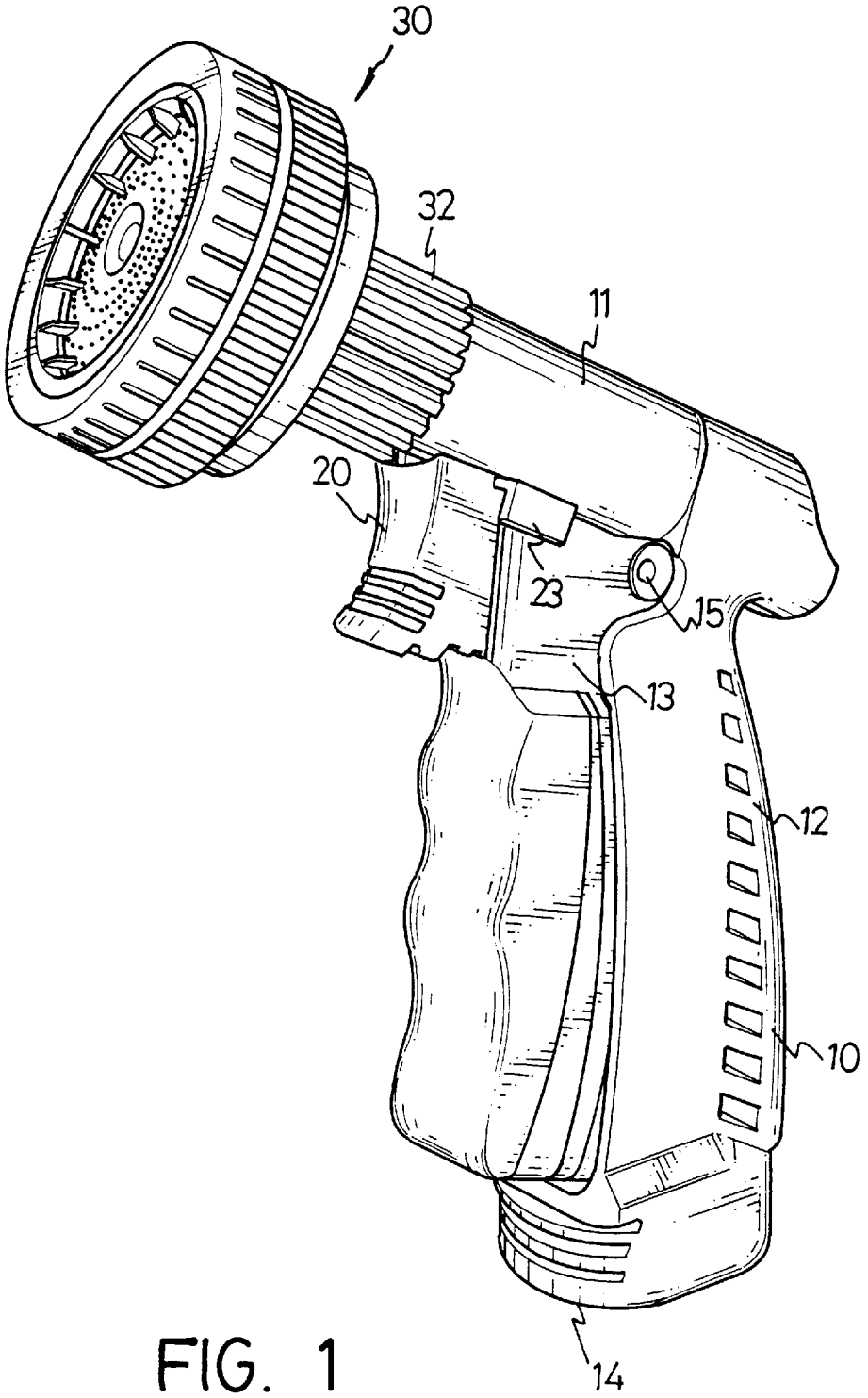
FIG. 1 is a perspective view showing a pistol-grip nozzle in accordance with the present invention.

Referring to FIG. 1, a pistol-grip nozzle in accordance with the present invention includes an inverted "L" shaped metal hollow handle 10 formed with a transverse section 11 and a longitudinal section (not numbered) communicated therewith. The longitudinal section and its juncture with the transverse section 11 are enclosed by a casing 12 for providing a better grip to a user. A free end 14 of the longitudinal section is connected with a water hose (not shown) and a free end of the transverse section is connected to a rose 30 through a connecting tube 32. A trigger 13 is disposed inside the juncture of the transverse section 11 and the longitudinal section of the handle 10. The longitudinal section has a valve means (not shown) disposed therein, a side pipe (not shown) therein communicated with the valve and push rods (not shown) disposed within the side pipe for controlling the valve by actuation of the trigger 13. Since these are prior arts, detailed description is omitted.

Figure 2:
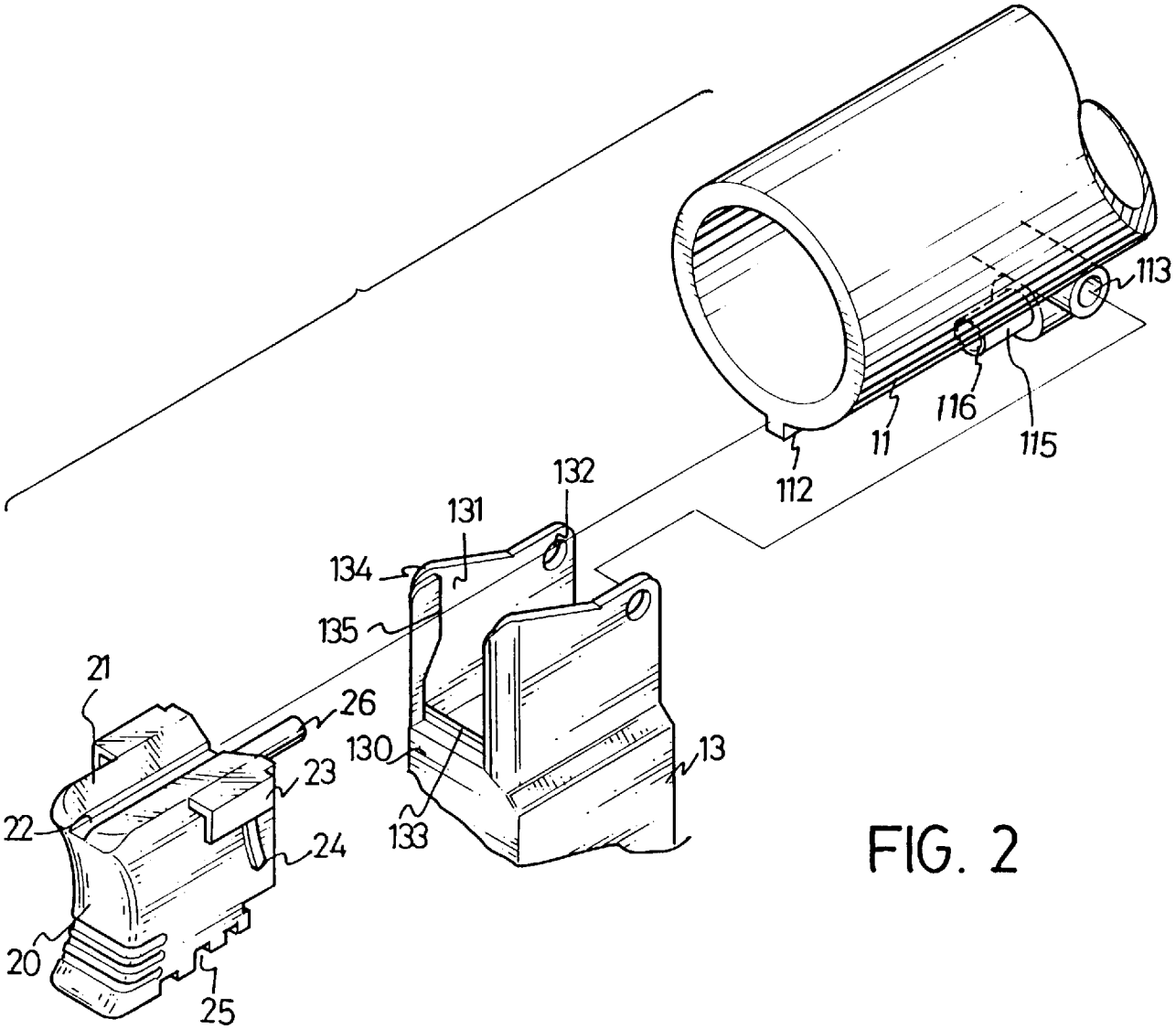
FIG. 2 is a partially exploded view showing an actuating means of the pistol-grip nozzle in accordance with the present invention.

Now referring to FIG. 2, it can be seen that the transverse section 11 has a tenon 112 integrally formed at a bottom exterior along a length thereof. A shaft sleeve 113 is transversely mounted at a rear portion beneath the transverse section approaching the juncture with the longitudinal section. A shaft sleeve 115 with a hole 116 is longitudinally formed at an inside of the shaft sleeve 113. The trigger 13 is formed with a base 130 and a pair of side pieces 134 oppositely disposed on a top of the base 130 so that a space 131 is defined by the two side pieces 134 and a top surface of the base 130 for receiving a control means 20. A pair of holes 132 corresponding to the shaft sleeve 113 is defined at an appropriate position on the pair of side pieces 134 so that the trigger 13 can be mounted to the shaft sleeve 113 by a pin 15 (with a reference to FIG. 4) extending through the holes 132 and shaft sleeve 113.

Figure 3:
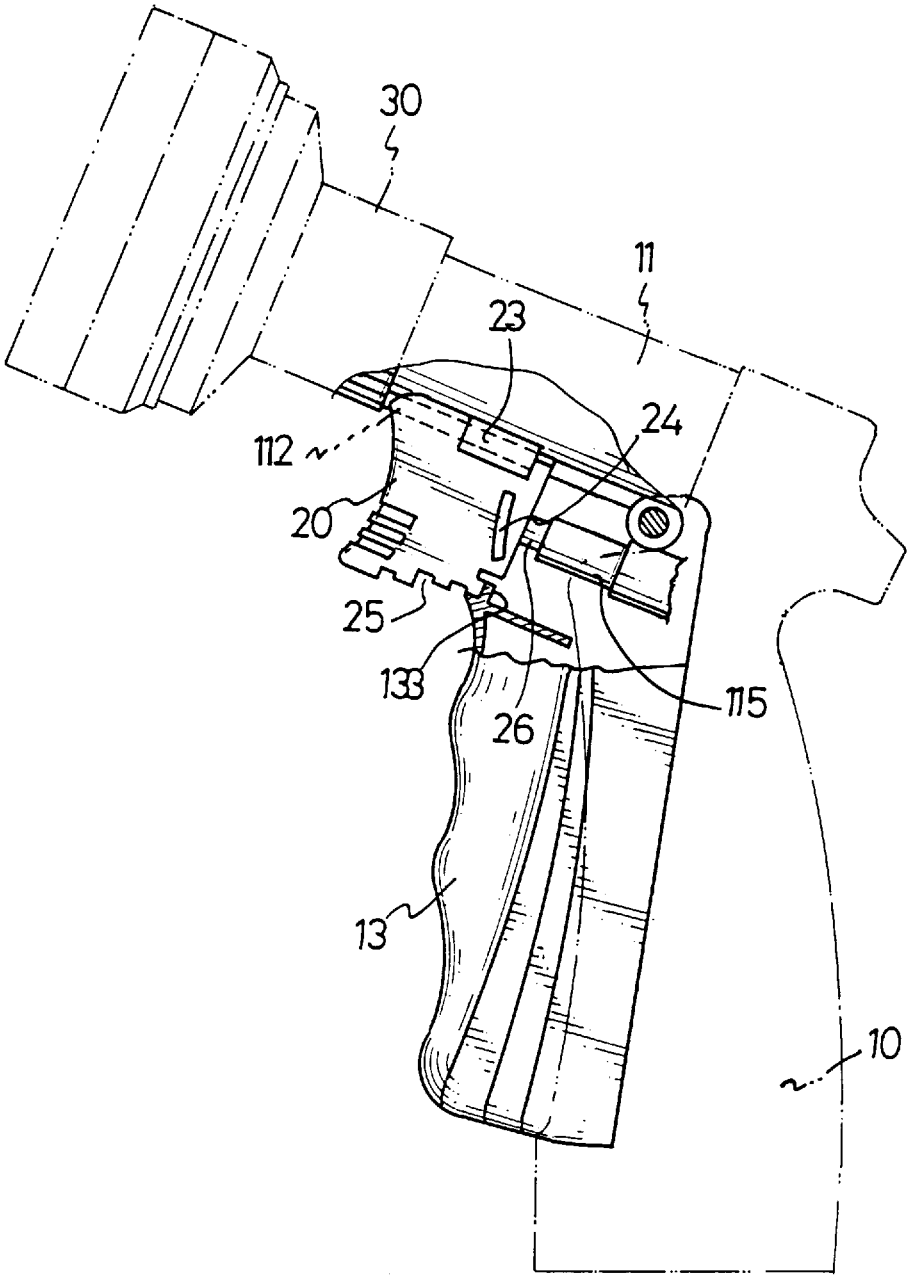
FIG. 3 is a schematic view showing a first operation of a trigger of the pistol-grip nozzle in accordance with the present invention.
Figure 4:
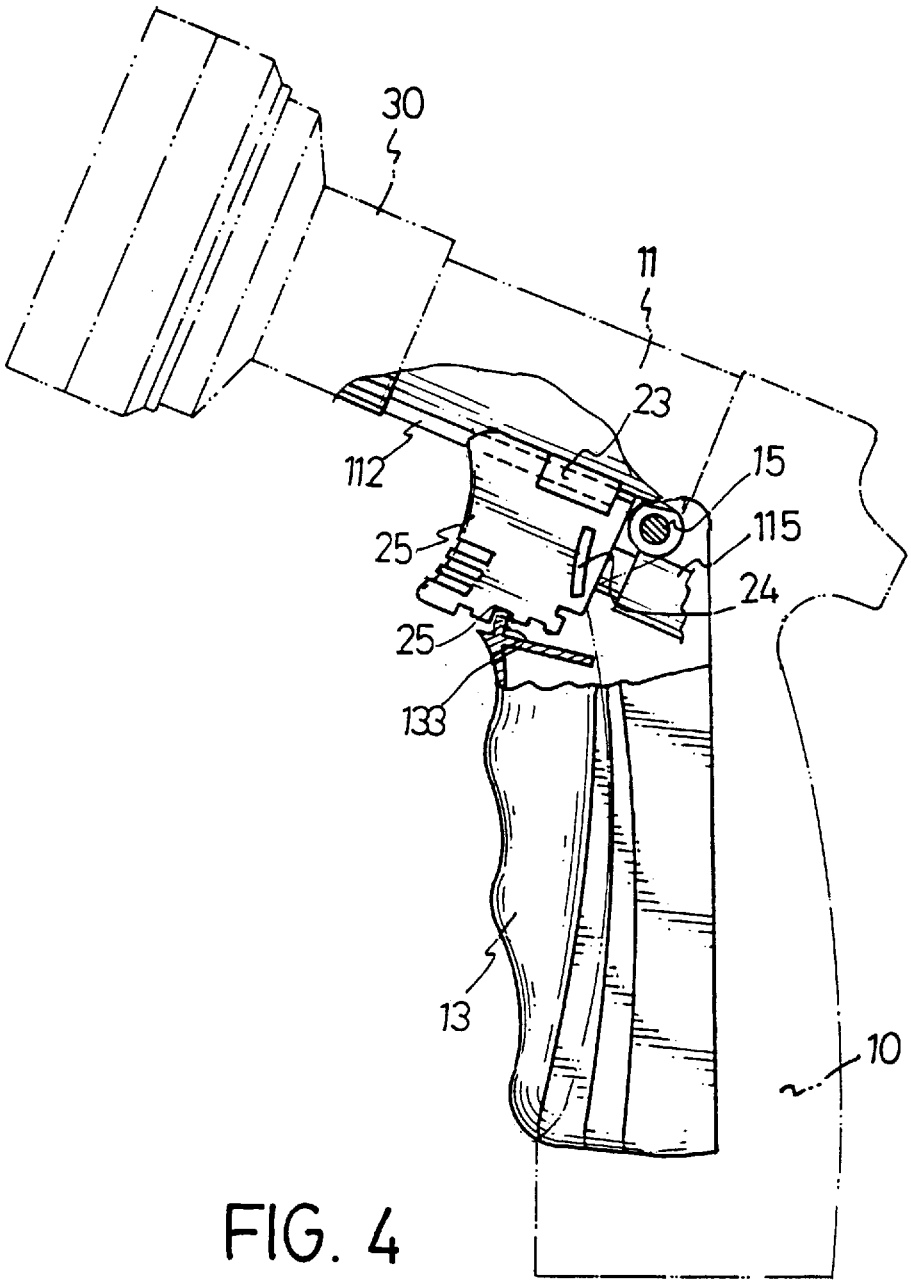
FIG. 4 is a schematic view showing a second operation of the trigger of the pistol-grip nozzle of FIG. 3.

Now referring to FIG. 3 and FIG. 4 and taking FIG. 2 as reference, a pair of flanges 135 integrally and oppositely extend from a front edge of each side piece 134 and an upward lip 133 extends between the bottoms of the two side flanges 135. The control means 20 has a cambered surface 21 defined at a top thereof, correspond to the bottom of the transverse section 11 of the handle 10 for close engagement therewith. A groove 22 is defined at a center of the cambered surface 21 along a length thereof to engage with the tenon 112 of the handle 10 so that the control means 20 can be slidably moved on the tenon 112 of the handle 10. A guide post 26 extends from an appropriate position at an inner end of the control means 20 so that it can be received within the hole 116 of the shaft sleeve 13 for a further location and fastening. The control means 20 further defines a series of recesses 25 at a bottom thereof each of which can engagingly receive the upward lip 133 of the trigger 13 according to requirements. Also, a pair of wing members 23 is provided on a top and rear portion of opposed sides of the groove 22 of the control means 20. A pair of stop levers 24 are respectively provided beneath the wing members 23. Each wing member 23 has a cross section shaped as a numeral "7" so that an inner space defined therebetween exactly permits the top portion of the two side pieces 134 of the trigger 13 to extend therethrough, whereby when the control means 20 is set into the space 131 of the trigger 13, the wing members can move on the tops of the pair of side pieces 134 of the trigger 13, the pair of stop levers 24 will be retained by the pair of flanges 135 of the trigger 13 to limit the displacement of the control means 20, and any one of the recesses 25 can engagingly receive the upward lip 133 of the trigger 13 according to different shift distances of the trigger 13 to meet the requirements of spraying various water patterns. Since the pair of side pieces 134 of the trigger 13 is restricted by the wing members 23 of the control means 20, the trigger 13 can not be separated from the shaft sleeve 13 no matter how great the water pressure is thereon.

Figure 5:
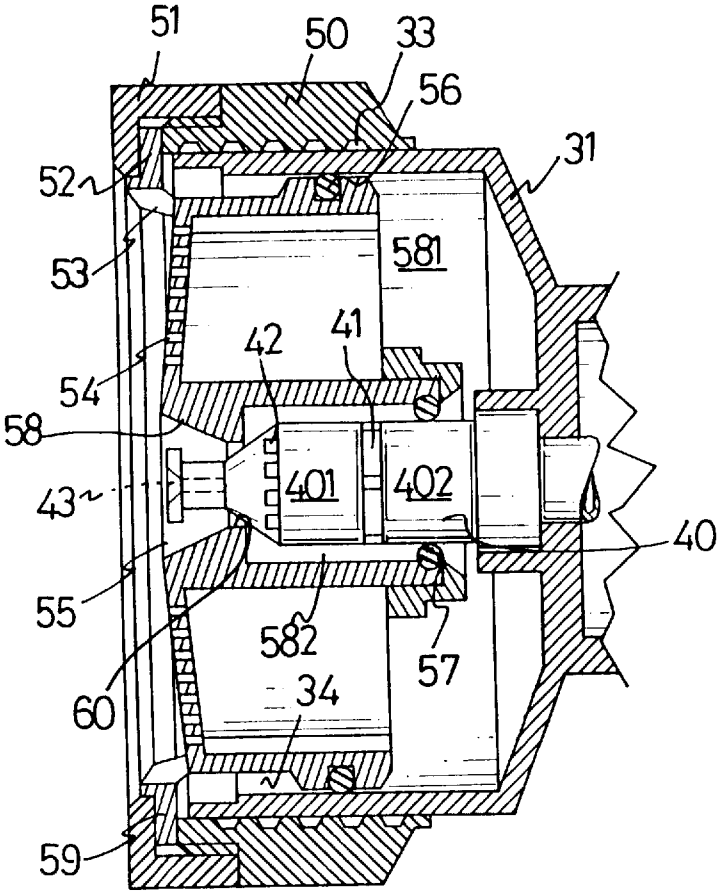
FIG. 5 is a first schematic view showing a pattern plate and an outlet pipe of the pistol-grip nozzle in accordance with the present invention.

FIG. 1 and FIG. 5 show schematic views of a rose 30 and an outlet pipe of the pistol-grip nozzle in accordance with the present invention. The rose 30 connected to the free end of the transverse section 11 through the connecting pipe 32 comprises a hollow body 31 shaped as a cylinder with an external thread 33. A distribution pipe 58 is arranged at a center of the body 31 so that it defines an outer space 581 and an inner space 582 in the body 31. An outlet pipe 40 communicated with the connecting pipe 32 is disposed within the distribution pipe 58. The outlet pipe 40 is divided into a first section (not numbered) and a second section (not numbered) defining a first chamber 401 and a second chamber 402, respectively. The first chamber 401 defines a plurality of openings 42 at a periphery of the wall of the first section outlet pipe and communicates to a tapered front end which defines a central hole 43 therein. The second chamber 402 defines a plurality of holes 41 on the wall of the second section outlet pipe approaching the first chamber 401. A tapered hole 55 and a gap 60 are each defined by an inner space wall of the distribution pipe 58 and the wall of the first section outlet pipe. A pattern plate 52 is mounted within a front portion of the body 31. The pattern plate 52 is provided with a plurality of apertures 54 defined thereon to communicate with the outer space 581 and a plurality of throats 53 in communication with the apertures 54 for spraying various water patterns under various water pressures. Also, a rotator 50 with an internal thread is threadedly engaged with the body 31 and a cover 51 is threadedly mounted to the rotator 50 to fasten the pattern plate 52 by means of a collar 59 extending from the periphery of the pattern plate 52. Furthermore, a first seal loop 56 is disposed between an outside wall of the distribution pipe 58 and an inside wall of the body 31 and a second seal loop 57 is disposed between an inside wall of the distribution pipe 58 and an outside wall of the second chamber 402 of the outlet pipe 40.

Referring to FIG. 5, there is shown a first embodiment of the pistol-grip nozzle in accordance with the present invention. When rotating the rotator 50 with respect to the body 31 to a position as shown in FIG. 5, it can be seen that water entering from the connecting pipe 32 to the outlet pipe 40 will overflow from the hole 41 of the second chamber 402 to the inner space of 582 defined by the distribution pipe 58 and enter into the first chamber 401 from the openings 42 because it is resisted by the second seal loop 57. Then water will flow into the central hole 43 communicated with the first chamber 401 and send out a water jet.

Figure 6:
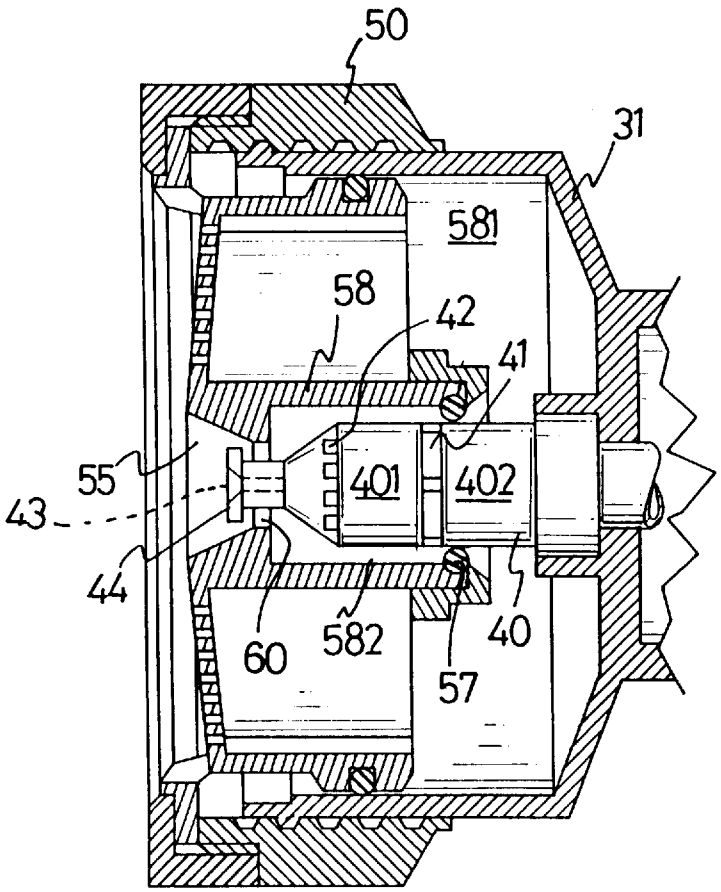
FIG. 6 is a second schematic view showing a pattern plate and an outlet pipe of the pistol-grip nozzle in accordance with the present invention.
Figure 9:
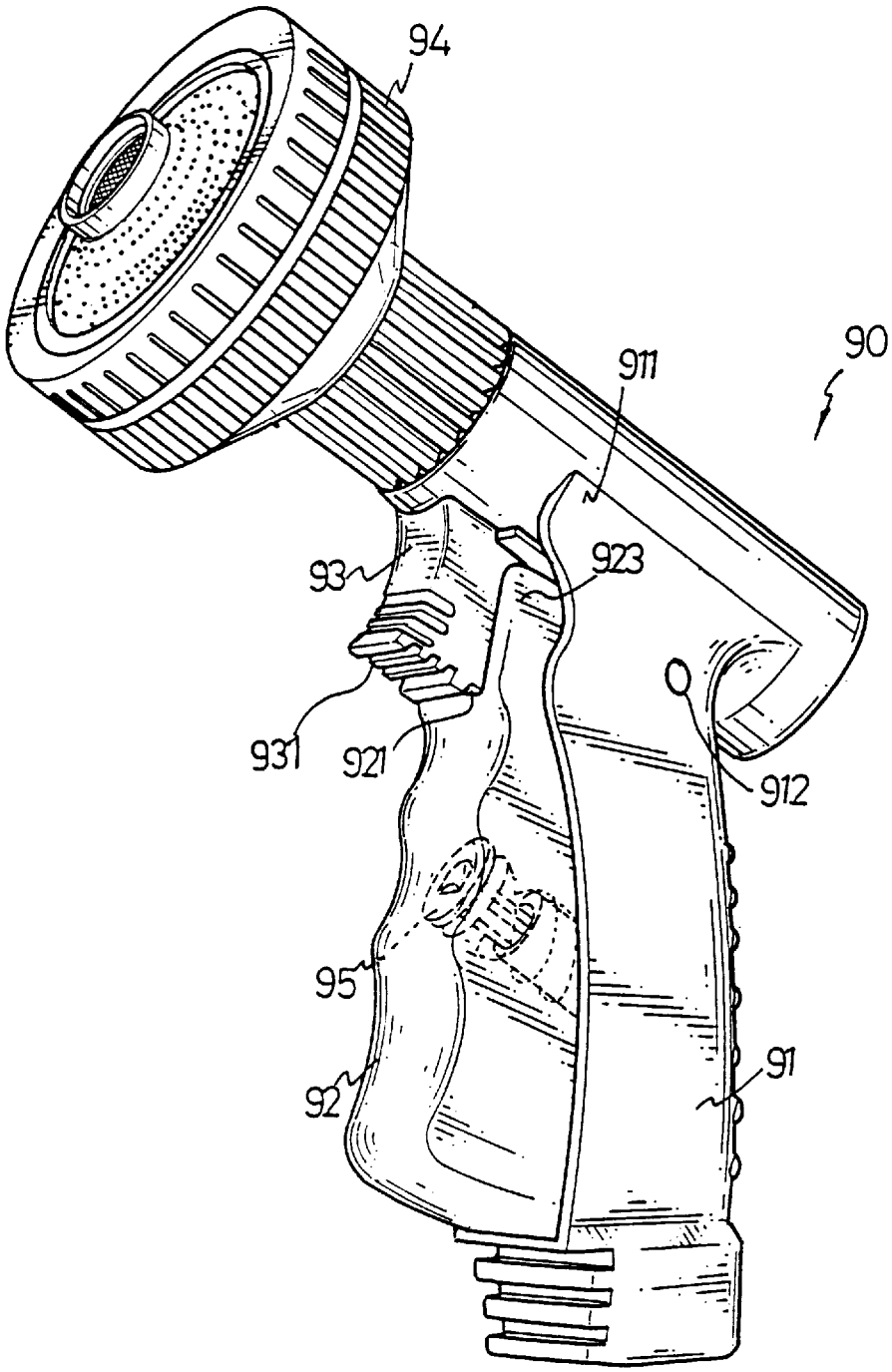
FIG. 9 PRIOR ART
FIG. 9 is a perspective view showing a conventional pistol-grip nozzle.

FIG. 6 shows a second embodiment of the pistol-grip nozzle in accordance with the present invention. When continuing to rotate the rotator 50 with respect to the body 31 to a position as shown, it can be seen that water to the outlet pipe 40 will overflow from the hole 41 of the second chamber 402 to the inner space of 582 defined by the distribution pipe 58 and enters into the first chamber 401 from the openings 42 because it is resisted by the second seal loop 57. Then one part of the water will flow into the central hole 43 communicated with the first chamber 401 and send out a water jet. The remainder of the water will flow into the tapered hole 55 through the gap 60 and send out radiating water.

Figure 7:
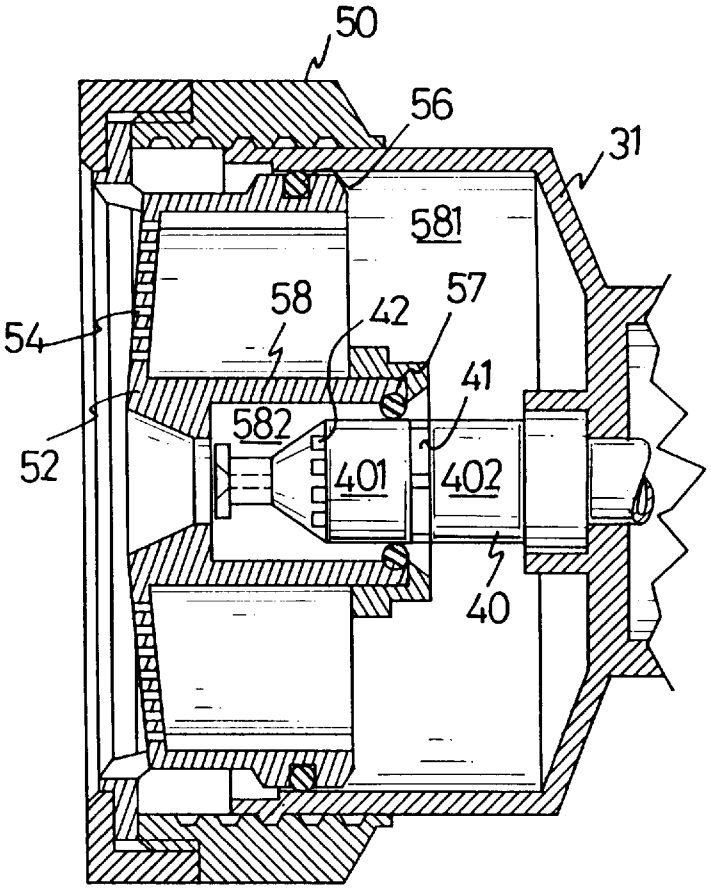
FIG. 7 is a third schematic view showing a pattern plate and an outlet pipe of the pistol-grip nozzle in accordance with the present invention.

Referring to FIG. 7, there is shown a third embodiment of the pistol-grip nozzle in accordance with the present invention. When continuing to rotate the rotator 50 with respect to the body 31 to a position as shown, it can be seen that water to the outlet pipe 40 will overflow from the hole 41 of the second chamber 402 to the outer space of 581 defined by the distribution pipe 58 because it is resisted by the first and second seal loops 56, 57 and the first chamber 401 of the outlet pipe 40, and overflows from apertures 54 of the pattern plate 52, forming a plurality of slim water jets.

Figure 8:
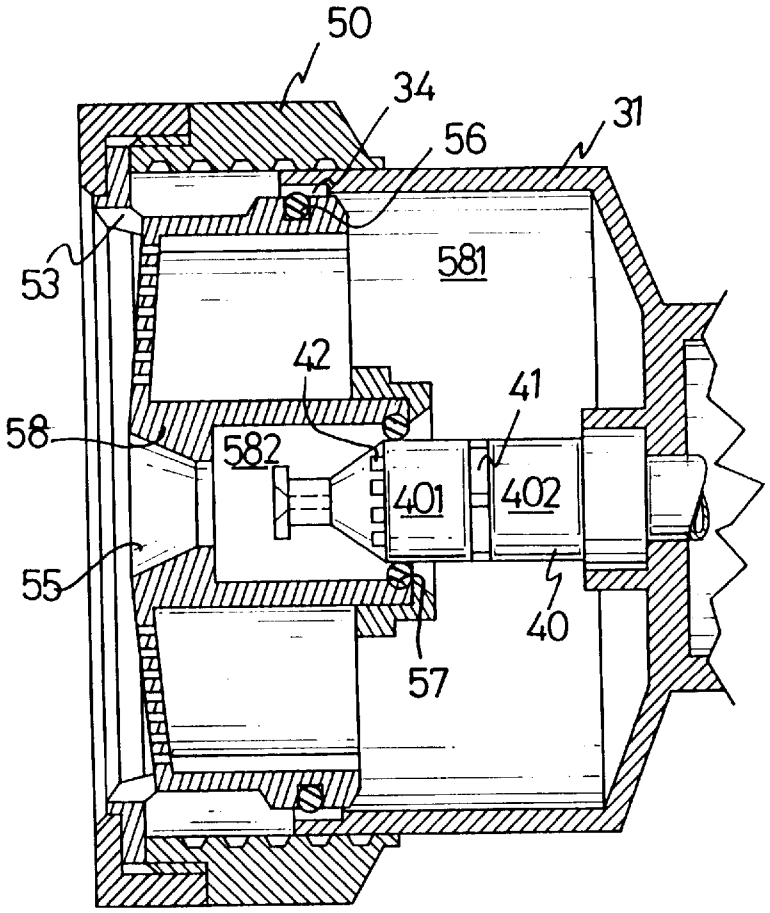
FIG. 8 is a fourth schematic view showing a pattern plate and an outlet pipe of the pistol-grip nozzle in accordance with the present invention.

Referring to FIG. 8, there is shown a fourth embodiment of the pistol-grip nozzle in accordance with the present invention. When continuing to rotate the rotator 50 with respect to the body 31 to a position as shown, it can be seen that water to the outlet pipe 40 will overflow from the hole 41 of the second chamber 402 to the outer space of 581 defined by the distribution pipe 58 because it is resisted by the second seal loop 57 and the first chamber 401 of the outlet pipe 40. Also, since the inside wall of the body 31 forms a step 34 at an appropriate position thereof and the first seal loop 56 is exactly located at the step 34 in this case, the first seal loop 56 fails to resist the water to enter into the throats 53, whereby, one part of the water will be sent out through the apertures 54 and the remainder of the water will be sent out through the throats 53.

Accordingly, the pattern plate 52 provides various water patterns according to various water pressures supplied by means of the trigger 13 being engagingly received in any one of various recesses of the control means 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pistol-grip nozzle comprising:

an inverted "L" shaped metal hollow handle formed of a transverse section and longitudinal section communicating therewith, said transverse section having a tenon formed along a length of a bottom portion thereof;

a rose threadedly mounted to a free end of the transverse section of the hollow handle;

a trigger disposed inside a juncture of the transverse section and the longitudinal section, said trigger having a base and a pair of side pieces oppositely disposed on a top portion of the base in order to define a space therebetween, said trigger further having a pair of flanges integrally and oppositely extending form a front edge of each side piece and an upward lip traversing the bottoms of the flanges; and control means received within the space defined by the trigger, said control means having a cambered top surface to correspond to the bottom of the transverse section of the hollow handle, a groove defined at a center of the cambered surface along a length thereof to slidably engage with the tenon of the hollow handle, a guide post integrally extending from a position at an inner end, a series of recesses defined at a bottom thereof to engagingly receive the upward lip of the trigger according to requirements, a pair of wing members provided on a top and rear portion of opposed side surfaces thereof, and a pair of stop levers respectively provided beneath the wing members and retained by the pair of flanges of the trigger.

2. A pistol-grip nozzle as claimed in claim 1, wherein the transverse section further has a first shaft sleeve transversely mounted at a rear portion therebeneath approaching the juncture with the longitudinal section for mounting the trigger by a pin passing therethrough.

3. A pistol-grip nozzle as claimed in claim 1, wherein the transverse section of the hollow body further comprises a second shaft sleeve longitudinally formed at an inside of the first shaft sleeve for receiving the guide post of the control means of the trigger.

4. A pistol-grip nozzle comprising:

an inverted "L" shaped metal hollow handle formed of a transverse section and a longitudinal section communicated therewith, said transverse section having a male thread on a free end thereof;

a trigger disposed inside a juncture of the transverse section and the longitudinal section; and a rose threadedly mounted to a free end of the transverse section of the hollow handle via a connecting pipe, said rose including:

a hollow body shaped as a cylinder with a male thread;

a rotator with a female thread threadedly engaged with the hollow body;

a distribution pipe arranged at a center of the body so that it defines an outer space and an inner space in the body, said distribution pipe having a first seal loop disposed between an outside wall thereof and an inside wall of the body;

an outlet pipe communicated with the connecting pipe and disposed within the distribution pipe, said outlet pipe being divided into a first chamber and a second chamber, said first chamber defining a plurality of openings at a periphery of the pipe wall thereof in order to communicate with a tapered front end which defines a central hole therein, said second chamber defining a plurality of holes on the pipe wall thereof approaching the first chamber and having a second seal loop disposed between an inside wall of the distribution pipe and an outside wall of the second chamber of an outlet pipe;

a pattern plate mounted within a front portion of the body, said pattern plate having a plurality of apertures defined thereon to communicate with the outer space defined by the distribution pipe and a plurality of throats in communication with the apertures; and a cover threadedly mounted to the rotator to fasten the pattern plate by means of a collar extending from the periphery of the pattern plate.

5. A pistol-grip nozzle as claimed in claim 4, wherein a tapered hole and a gap are defined in an inner space wall of the distribution pipe and a wall of the tapered front end of the first chamber.

* * * * *